US006582476B1

(12) United States Patent
Binder et al.

(10) Patent No.: US 6,582,476 B1
(45) Date of Patent: Jun. 24, 2003

(54) DURABLE WRINKLE REDUCTION LAUNDRY PRODUCT COMPOSITIONS WITH IMPROVED SOFTNESS AND WRINKLE REDUCTION

(75) Inventors: David Alan Binder, Saddlebrook, NJ (US); Dennis Stephen Murphy, Wyckoff, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 85 days.

(21) Appl. No.: 09/706,655

(22) Filed: Nov. 6, 2000

Related U.S. Application Data

(60) Provisional application No. 60/170,934, filed on Dec. 15, 1999.

(51) Int. Cl.[7] ..... D06M 13/322; D06L 1/04

(52) U.S. Cl. ..... 8/196.1; 8/137.5; 510/285

(58) Field of Search ..... 510/285; 8/196.1, 8/137.5

(56) References Cited

U.S. PATENT DOCUMENTS

| | | | | |
|---|---|---|---|---|
| 4,076,917 A | | 2/1978 | Swift et al. | 526/49 |
| 4,115,637 A | | 9/1978 | Cenci et al. | 526/56 |
| 4,658,003 A | | 4/1987 | Schmidt et al. | 526/278 |
| 4,693,847 A | | 9/1987 | Johnson, Jr. | 260/104 |
| 4,795,533 A | | 1/1989 | Young et al. | 204/1 |
| 4,820,307 A | | 4/1989 | Welch et al. | 8/120 |
| 4,857,586 A | | 8/1989 | Bachem et al. | 524/845 |
| 4,936,865 A | | 6/1990 | Welch et al. | 8/120 |
| 4,975,209 A | | 12/1990 | Welch et al. | 252/8.6 |
| 5,042,986 A | | 8/1991 | Kitchens et al. | 8/120 |
| 5,077,361 A | | 12/1991 | Hughes et al. | 526/233 |
| 5,137,537 A | | 8/1992 | Herron et al. | 8/120 |
| 5,143,582 A | | 9/1992 | Arkens et al. | 162/135 |
| 5,145,485 A | | 9/1992 | Michna et al. | 8/527 |
| 5,173,201 A | | 12/1992 | Coffindaffer et al. | 252/8.8 |
| 5,199,953 A | | 4/1993 | Fung et al. | 8/120 |
| 5,221,285 A | | 6/1993 | Andrews et al. | 8/127.1 |
| 5,235,082 A | | 8/1993 | Hill et al. | 556/425 |
| 5,273,549 A | | 12/1993 | Didier et al. | 8/127.1 |
| 5,427,587 A | | 6/1995 | Arkens et al. | 8/116.1 |
| 5,718,728 A | | 2/1998 | Arkens et al. | 8/116.1 |
| 5,760,155 A | * | 6/1998 | Mowrer et al. | 528/12 |
| 5,965,517 A | | 10/1999 | Mooney | 510/516 |

FOREIGN PATENT DOCUMENTS

| | | |
|---|---|---|
| EP | 0 523 910 A1 | 1/1993 |
| WO | 98/04772 | 2/1998 |

OTHER PUBLICATIONS

International Search Report dated May 4, 2001 on PCT/EP 00/12536 Nov. 12, 2000.

*Introduction of Ester Links into Cotton Cellulose by a Rapid Curing Process*, Rowland et al., 1967, Textile Research Journal, pp. 933–941 Jun. 30, 1967.

*Mobile Ester Cross Links for Thermal Creasing of Wrinkle–Resistant Cotton Fabrics*, Rowland et al., Textile Research Journal, 1968, pp. 634–643 Oct. 23, 1967.

* cited by examiner

*Primary Examiner*—Yogendra N. Gupta
*Assistant Examiner*—Preeti Kumar
(74) *Attorney, Agent, or Firm*—Alan A. Bornstein

(57) ABSTRACT

The present disclosure relates to durable wrinkle reduction products that have improved softness. In a preferred embodiment, silicone containing compounds are incorporated into the cross-linked matrix of cellulosic fibers.

7 Claims, No Drawings

DURABLE WRINKLE REDUCTION LAUNDRY PRODUCT COMPOSITIONS WITH IMPROVED SOFTNESS AND WRINKLE REDUCTION

This application claims the benefit of provisional application No. 60/170,934, filed Dec. 15, 1999.

FIELD

The present disclosure relates to laundry product compositions that provide a substrates, such as fabrics, with durable wrinkle reduction benefits and with improved softness. The composition can be used in both domestic and industrial processes.

BACKGROUND

Durable press treatments (a.k.a. "permanent" press treatments) in the textile industry are well known. In the 1960's, it was known to use polycarboxylic acids for permanent press treatment of textiles. Generally, cellulose fiber can be cross-linked and esterified with polycarboxylic acids, particularly those with two or more carboxylic acid groups. Esterification is achieved upon heating the treated cellulose fibers such as by ironing or other from of heat pressing. Curing catalysts, such as phosphorous containing salts, are also known and serve to aid cross-linking. The treated and cured textile is generally strengthened and is less likely to wrinkle during use. Examples of U.S. Patent relating to durable press finishing of cotton textile with polycarboxylic acids include: U.S. Pat. No. 4,820,307 (Welch et al.), U.S. Pat. No. 4,975,209 (Welch et al.) and U.S. Pat. No. 5,221,285 (Andrews et al.). The contents of these patents are incorporated by reference.

A disadvantage of known durable press treatments is that the treated and cured textile is typically less soft as compared to the uncured textile. In order to increase softness, inert nonionic or anionic materials have been proposed in formulations as fabric softeners. These softeners include polyethylene, polypropylene and silicone softeners. A disadvantage of these softeners is that they require an additional treatment step subsequent to the durable press treatment and are not durable.

Therefore, there is a need for durable press treatments that not only impart wrinkle reduction benefits but also impart softness benefits, i.e. durable softness. It would be preferable of the softness benefits could be achieved without additional steps subsequent to the durable press treatment.

SUMMARY

The present disclosure relates to durable wrinkle reduction products that impart durable softness. The products can be any substrate that have hydroxyl groups capable of forming cross-linked matrices. If the substrate is a fabric, the softness benefits are realised, for example, after machine or line drying.

In a preferred embodiment, silicone containing compounds are incorporated into the cross-linked matrix of cellulosic fibers of fabric. This is achieved by either 1) reacting the hydroxyl groups of the cellulosic fibers with polycarboxylic acids, wherein the polycarboxylic acids have silicone containing molecules and/or 2) by reacting other molecules having both hydroxyl groups and one or more silicones with the cross-linked polycarboxylic acid/cellulose matrix. It is believed that the incorporated silicone molecules will provide lubrication of the fiber surfaces, resulting in wrinkle reduction, softening and less abrasion on the fiber surface. A most preferred embodiment includes silicone carboxylates, however any silicone compound containing a hydroxy or silanol group or other functional group that can react with the cross-linked matrix can provide the desired affect. When cured, to form an ester, the silicone containing molecules are difficult to remove under normal wash and wear conditions.

DESCRIPTION OF THE PREFERRED EMBODIMENTS

Durable press treatment of cellulosic fibers is achieved by the esterification of cellulosic hydroxyl groups with polycarboxylic acids. The present disclosure of durable softness is achieved by including silicone carboxylates into the formulations. Silanols and hydroxy containing organically modified silicone fluids can be incorporated into the cross-linked matrix by reacting with (i.e. another esterification reaction) with the polycarboxylic acid.

Other molecules containing multiple hydroxyl groups, such as triethanol amine, can be incorporated into the cross-linked matrix. The silicone carboxylates could also react with these molecules.

The durable softness compounds are preferably selected form the following molecular classes: silicon carboxylates; silanol fluids; silanols and hydroxy containing organically modified silicone fluids. Most preferred compounds are carboxylic acid derivatized silicones that include any silicone with a —COOH group. These compounds are preferably incorporated into formulations useful for forming cross-linked matrices with cellulosic fibers. Preferred compounds for forming cross-linked matrices include, for example, 1,2,3,4 cyclopentanetetracarboxylic acid, 1,2,3,4 butanetetracarboxylic acid (BTCA) and polyacrylic acids. Other suitable carboxylic acids are disclosed in the above-cited patents and in U.S. Pat. No. 5,965,517 (Mooney), the contents of which are incorporated herein by reference.

A highly preferred composition in accordance with the present disclosure is Monosil® PCA (polysiloxyl pyrrolidone carboxylic acid, CAS number 179005-03-9) available from Mona Industries, Easley, S.C., which is included with BTCA to form the desired cross-linked matrix.

EXAMPLES

The following formulations were made by: 1) adding the ingredients in the order indicated to about 50 g water for each 100 g of formulation; 2) stirring until homogeneous; and 3) adding water to the final weight while stirring. SDS is sodium dodecyl benzene sulfonate.

Example A

| Ingredient | Activity | grams/100 g (wt. %) |
|---|---|---|
| BTCA | 35.0% | 18.0 |
| $NaHPO_2$ | 100.0% | 1.0 |
| Malic Acid | 100.0% | 1.8 |
| PCA (Monosil) | 100.0% | 0.0 |
| SDS | 100.0% | 0.0 |
| Water | 100.0% | 79.2 |

Example B

| Ingredient | Activity | grams/100 g (wt.) |
|---|---|---|
| BTCA | 35.0% | 18.0 |
| $NaHPO_2$ | 100.0% | 1.0 |
| Malic Acid | 100.0% | 1.8 |
| PCA (Monosil) | 100.0% | 0.0 |
| SDS | 100.0% | 3.0 |
| Water | 100.0% | 76.2 |

Example C

| Ingredient | Activity | grams/100 g (wt %) |
|---|---|---|
| BTCA | 35.0% | 18.0 |
| $NaHPO_2$ | 100.0% | 1.0 |
| Malic Acid | 100.0% | 1.8 |
| PCA (Monosil) | 100.0% | 2.0 |
| SDS | 100.0% | 3.0 |
| Water | 100.0% | 74.2 |

The above formulations were tested for both wrinkle reduction and softness qualities. Formulation A is the control, formulation B has 3% SDS and formulation C features 3 wt % SDS and 2 wt % Monosil® PCA. Cotton cloths were processed as follows: 1) soaked in the respective formulations for five (5) minutes; 2) dried overnight; 3) ironed (cotton setting); 4) laundered in a Kenmore® series 90 machine set to hot wash/cold rinse (12 minute regular cycle) using all® laundry; and 5) dried in a Kenmore® series 90 electric dryer on cotton (high) setting (50 minute cycle). Wrinkle and softness data were taken after a first wash. Additional wrinkle and softness data were taken after four more washes to investigate softness durability.

Wrinkle reduction was measured by using the American Association of Textile Chemists and Colorists' (AATCC) method # 124, Appearance of Fabrics after Repeated Home Laundering. In this method, cloths are washed and dried. The dried cloths are then evaluated for wrinkle content by comparison with wrinkle smoothness replicas that can be purchased from AATCC. Factors such as the light used, the angle of the cloths and replicas to the light, and the background are carefully controlled and described in the method. There are six replicas with values of 1, 2, 3, 3.5, 4, and 5 with 5 being perfectly smooth and 1 being very wrinkled. Three trained observers are asked to give a value of 1–5, to the nearest 0.5 unit, to each cloth based on which replica it most closely resembles. The results are totalled and averaged over the three observers. According to the method, a difference of greater than 0.17 between the results for two products indicates there is a significant difference at the 95% confidence level. A difference of greater than or equal to 0.25 indicates a significant difference at the 99% confidence level FIRST WASH - wrinkle results

| Formulation | Observer 1 | Observer 2 | Observer 3 | Average |
|---|---|---|---|---|
| A | 2.67 | 2.67 | 3.0 | 2.78 |
| B | 2.17 | 2.83 | 2.83 | 2.61 |
| C | 2.67 | 3.17 | 3.17 | 3.0 |

As shown in the above data Formulation C had perceptible wrinkle reduction qualities with a confidence level exceeding 99 percent.

The cloths after the first wash were also observed for softness, wherein the observers chose those that which felt soft. Observer A chose three cloths, all washed with formulation C. Observer B chose three cloths washed with formulation C and one cloth washed with formulation B. Observer C chose two cloths from formulation C (observer C was unable to choose a third cloth based on softness).

The cloths from the above tests were washed four more times, as described above. The following wrinkle and softness data were obtained.

After Five washes WASH - wrinkle results

| Formulation | Observer 1 | Observer 2 | Observer 3 | Average |
|---|---|---|---|---|
| A | 2.5 | 2.67 | 2.67 | 2.61 |
| B | 2.0 | 2.5 | 2.67 | 2.31 |
| C | 3.0 | 2.83 | 3.0 | 2.94 |

The above data shows consistent wrinkle reducing properties in at least the 99% confidence level.

The cloths after the five washes were also observed for softness, wherein the observers were asked to choose three cloths that felt softest. Observer A chose three cloths, all washed with formulation C. Observer B chose two cloths washed with formulation C (a third was not chosen). Observer C chose three cloths from formulation C.

As such, the incorporation of silicone in the cross-linked matrix of the cellulosic fibers exhibits not only durable press properties, but durable softness properties.

What is claimed is:

1. A method for treating a fabric comprising, in no particular order, the steps of:

(a) contacting a hydroxy comprising fabric with at least one combination or compound selected from the group consisting of a first compound and a second compound, the first compound and a third compound, the second compound and the third compound; and the second compound; and (1) allowing the first and the second compound to react with a hydroxy group of the fabric, or (2) allowing the first or the second compound to react with a hydroxy group of the fabric and the third compound to react with the first or second compound, or (3) allowing the second compound to react with a hydroxy group of the fabric, or (4) allowing any combination of steps (1) to (3);

wherein the first compound is a polycarboxylic acid, the second composition is a reactive functionalized siloxane and the third compound is a silicone compound containing a hydroxy group, a silanol group, or another functional group that can react with the first compound or the second compound.

2. A method for treating a fabric according to claim 1 further comprising the step of pressing the hydroxy comprising fabric after steps a and at least one of steps 1, 2, 3 and 4.

3. A method for treating a fabric according to claim 1 wherein the polycarboxylic acid is butane tetra carboxylic acid, the functionalized siloxane is a carboxylic acid functionalized siloxane and the silanol is a polyhydroxy silanol.

4. A method for treating a fabric according to claim 1 wherein the method further comprises the step of contacting the hydroxy comprising fabric with a fourth compound, the fourth compound comprising at least one hydroxy group.

5. A method for treating a fabric according to claim 4 wherein the fourth compound is triethanol amine.

6. A method for treating a fabric according to claim 1 wherein the fabric comprises cellulose comprising fibers.

7. A method for treating a fabric according to claim 1 wherein the first compound is a cyclopentane tetracarboxylic acid or a polyacrylic acid.

* * * * *